US008818228B2

(12) United States Patent
Saida

(10) Patent No.: US 8,818,228 B2
(45) Date of Patent: Aug. 26, 2014

(54) IMAGE FORMING SYSTEM, AND CONTROL APPARATUS, CONTROL METHOD AND STORAGE MEDIUM THEREFOR

(75) Inventor: Tadaaki Saida, Kashiwa (JP)

(73) Assignee: Canon Kabushiki Kaisha (JP)

( * ) Notice: Subject to any disclaimer, the term of this patent is extended or adjusted under 35 U.S.C. 154(b) by 221 days.

(21) Appl. No.: 12/986,489

(22) Filed: Jan. 7, 2011

(65) Prior Publication Data

US 2011/0176825 A1 Jul. 21, 2011

(30) Foreign Application Priority Data

Jan. 18, 2010 (JP) ..... 2010-008149

(51) Int. Cl.
*G03G 15/00* (2006.01)

(52) U.S. Cl.
CPC .. *G03G 15/5004* (2013.01); *G03G 2215/00021* (2013.01)
USPC ..... 399/75; 399/70

(58) Field of Classification Search
USPC ..... 399/70, 75, 306, 309, 364
See application file for complete search history.

(56) References Cited

U.S. PATENT DOCUMENTS

| | | | | |
|---|---|---|---|---|
| 4,586,812 | A * | 5/1986 | Kaneko et al. | 355/24 |
| 7,024,152 | B2 | 4/2006 | Lofthus et al. | |
| 7,245,838 | B2 * | 7/2007 | Swift | 399/8 |
| 2006/0039727 | A1 | 2/2006 | Lofthus et al. | |
| 2008/0199198 | A1 * | 8/2008 | Nishi | 399/69 |

FOREIGN PATENT DOCUMENTS

JP 2006-058881 A 3/2006

* cited by examiner

*Primary Examiner* — David Gray
*Assistant Examiner* — Michael Harrison
(74) *Attorney, Agent, or Firm* — Rossi, Kimms & McDowell LLP

(57) ABSTRACT

An image forming system capable of immediately responding to a job command given by a user, reducing power consumption, and preventing the service life of component parts from being adversely affected. In a case where no printing is to be performed, a main controller of the image forming system controls each of first and second image forming apparatuses of the image forming system to assume either a standby state or a sleep state. In a case where printing is to be performed, the main controller controls each of the first and second image forming apparatuses to assume either the standby state or the sleep state according to whether double-sided printing should be performed or single-sided printing should be performed.

5 Claims, 5 Drawing Sheets

FIG.6A

| | | STATE OF FIRST IMAGE FORMING APPARATUS | |
|---|---|---|---|
| | | SLEEP | STANDBY |
| STATE OF SECOND IMAGE FORMING APPARATUS | SLEEP | RESTORE BOTH FIRST AND SECOND IMAGE FORMING APPARATUSES TO STANDBY STATE | RESTORE SECOND IMAGE FORMING APPARATUS TO STANDBY STATE |
| | STANDBY | RESTORE FIRST IMAGE FORMING APPARATUS TO STANDBY STATE | MAKE NO CHANGE |

FIG.6B

| | | STATE OF FIRST IMAGE FORMING APPARATUS | |
|---|---|---|---|
| | | SLEEP | STANDBY |
| STATE OF SECOND IMAGE FORMING APPARATUS | SLEEP | RESTORE SECOND IMAGE FORMING APPARATUS TO STANDBY STATE | RESTORE SECOND IMAGE FORMING APPARATUS TO STANDBY STATE, AND SHIFT FIRST IMAGE FORMING APPARATUS TO SLEEP STATE |
| | STANDBY | MAKE NO CHANGE | SHIFT SECOND IMAGE FORMING APPARATUS TO SLEEP STATE |

IMAGE FORMING SYSTEM, AND CONTROL APPARATUS, CONTROL METHOD AND STORAGE MEDIUM THEREFOR

BACKGROUND OF THE INVENTION

1. Field of the Invention

The present invention relates to an image forming system including a plurality of image forming apparatuses coupled together, and relates to a control apparatus, a control method and a storage medium therefor.

2. Description of the Related Art

An image forming system (hereinafter, also referred to as the printing system) has been known that includes image forming apparatuses coupled together to perform printing on recording sheets (see, for example, Japanese Laid-open Patent Publication No. 2006-58881).

In such a printing system, an image forming apparatus disposed on the upstream side in a recording sheet conveyance direction (hereinafter, referred to as the upstream image forming apparatus) performs printing on one surfaces e.g., front surfaces, of recording sheets and an image forming apparatus disposed on the downstream side in the sheet conveyance direction (hereinafter, referred to as the downstream image forming apparatus) performs printing on the other surfaces, e.g., rear surfaces, of the recording sheets.

By means of the printing system including two image forming apparatuses coupled together, double-sided printing can be performed at a higher speed than when the double-sided printing is performed by a single image forming apparatus.

Meanwhile, some image forming apparatus can assume a waiting state where a fixing unit of the apparatus is held at a predetermined temperature so as to be ready for immediately starting printing. Such an waiting state is generally called a standby state.

Depending on the purpose of use of a printed product, printing is performed on only one surfaces or both surfaces of recording sheets that constitute the printed product. To perform one-sided printing by a printing system having two image forming apparatuses, it is enough to use one of the two image forming apparatuses.

Conventionally, among the two image forming apparatuses, the image forming apparatus not used for one-sided printing is held in a standby state where the fixing unit is adjusted at a predetermined temperature so as to be able to respond to a job command given by a user.

However, if the image forming apparatus not used for the one-sided printing is held in the standby state to wait for reception of the job command, electric power is unnecessarily consumed and the service life of component parts of the apparatus is adversely affected.

SUMMARY OF THE INVENTION

The present invention provides an image forming system and a control apparatus, a control method, and a storage medium, which are capable of immediately responding to a job command given by a user, reducing power consumption, and preventing the service life of component parts from being adversely affected.

According to a first aspect of this invention, there is provided an image forming system including first and second image forming apparatuses each for forming an image on a recording sheet according to image data, with the second image forming apparatus coupled to a downstream side of the first image forming apparatus in a recording sheet conveyance direction, which comprises a control unit configured, in a case where printing on a recording sheet is not to be performed, to control at least one of the first and second image forming apparatuses to assume either a standby state where printing can immediately be started or a sleep state where a power consumption is lower than in the standby state, wherein in a case where double-sided printing is to be performed to form an image on one surface of a recording sheet and form an image on another surface of the recording sheet, the control unit controls the first and second image forming apparatuses to assume the standby state, causes the first image forming apparatus to form the image on the one surface of the recording sheet, and then causes the second image forming apparatus to form the image on the other surface of the recording sheet, and wherein in a case where single-sided printing is to be performed to form an image on one surface of a recording sheet, the control unit controls the first image forming apparatus to assume the sleep state, controls the second image forming apparatus to assume the standby state, and causes the second image forming apparatus to perform the single-sided printing.

According to a second aspect of this invention, there is provided a control method for the image forming system described in the first aspect.

According to a third aspect of this invention, there is provided a storage medium storing a program for executing the control method described in the second aspect.

According to a fourth aspect of this invention, there is provided a control apparatus for controlling the image forming system described in the first aspect.

With this invention, whether each of the first and second image forming apparatuses should be restored from the sleep state to the standby state or should be shifted from the standby state to the sleep state is determined according to whether double-sided printing should be performed or single-sided printing should be performed. Accordingly, image formation can be carried out, while bringing only the image forming apparatus not used for printing into the sleep state, resulting in advantages that it is possible to immediately respond to a job command given by a user, to reduce power consumption, and to prevent the service life of component parts from being adversely affected.

Further features of the present invention will become apparent from the following description of an exemplary embodiment with reference to the attached drawings.

BRIEF DESCRIPTION OF THE DRAWINGS

FIG. 6A is a view showing a decision table referred to by the main controller to execute the state control process at double-sided printing; and FIG. 6B is a view showing a decision table referred to by the main controller to execute the state control process at single-sided printing.

DESCRIPTION OF THE EMBODIMENTS

The present invention will now be described in detail below with reference to the drawings showing a preferred embodiment thereof.

Figure 1:
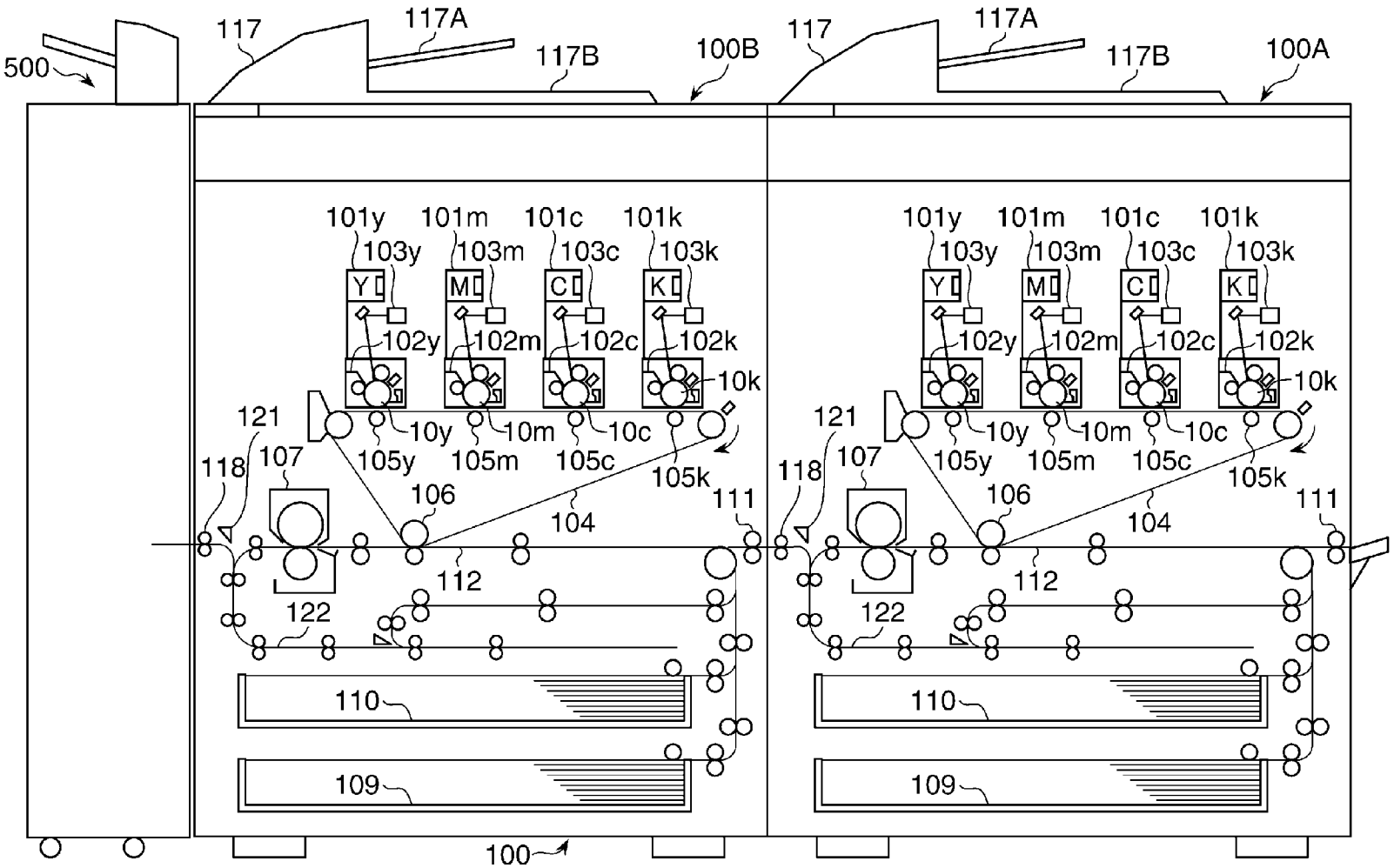
FIG. 1 is a schematic view showing an image forming system according to one embodiment of this invention.

FIG. 1 shows an example of an image forming system according to one embodiment of this invention. The illustrated image forming system 100 includes first and second image forming apparatuses 100A and 100B, which are connected (coupled) in tandem.

In the illustrated example, the first image forming apparatus 100A is an upstream image forming apparatus disposed on the upstream side in the direction to which a recording sheet is conveyed, and the second image forming apparatus 100B is a downstream image forming apparatus disposed on the downstream side in the sheet conveyance direction. On the downstream side of the second image forming apparatus 100B, there is disposed a post-processing apparatus 500 for performing post-processing such as book-binding.

The first and second image forming apparatuses 100A, 100B in the illustrated example are color printing image forming apparatuses, but this invention is also applicable to an image forming system where monochrome printing image forming apparatuses alone are used.

The first and second image forming apparatuses 100A, 100B are the same in construction. In the following, the construction and operation of the first image forming apparatus 100A will be described.

The first image forming apparatus 100A includes an original feeder 117 and an image reader (not shown). The original feeder 117 conveys originals, which are set on an original setting table 117A, one by one from the top page onto a platen glass (not shown) via a curved path, conveys the originals along the platen glass from left to right in FIG. 1, and discharges the originals to a discharge tray 117B.

While being conveyed, each original passes from left to right through a reader scanner unit (not shown) held in place. At that time, light is irradiated from the reader scanner unit onto the original, and reflection light reflected by the original is guided via mirrors to an image sensor, whereby the original is read by the reader scanner unit.

Alternatively, each original can be read by moving the reader scanner unit from left to right in FIG. 1 after the original is conveyed and stopped onto the platen glass by the original feeder 117.

The image sensor reads each original and outputs image information. The image information is subjected to image processing, where required, and then delivered as image data to exposure controllers 103*y*, 103*m*, 103*c*, and 103*k*, where suffixes y, m, c, and k respectively correspond to yellow, magenta, cyan, and black.

The exposure controllers 103*y*, 103*m*, 103*c*, and 103*k* irradiate laser light onto photosensitive drums 10*y*, 10*m*, 10*c*, and 10*k*, respectively, while controlling laser light output according to the image data, whereby electrostatic latent images are formed on the respective photosensitive drums 10*y*, 10*m*, 10*c*, and 10*k*.

The electrostatic latent images formed on the photosensitive drums 10*y*, 10*m*, 10*c*, and 10*k* are developed by developing units 102*y*, 102*m*, 102*c*, and 102*k* into toner images, which are sequentially transferred onto an intermediate transfer belt 104 by primary transfer units 105*y*, 105*m*, 105*c*, and 105*k*. In a case that the original is a color original, a color toner image is formed on the intermediate transfer belt 104.

Subsequently, the color toner image is transferred by a secondary transfer unit 106 onto a recording sheet supplied from any of recording sheet cassettes 109, 110, a sheet feeder 111, and a double-sided conveyance path 112. The recording sheet onto which the color toner image has been transferred is conveyed to a fixing unit 107 where the toner image is fixed to the sheet.

The recording sheet passing through the fixing unit 107 is temporarily guided by a flapper 121 to an inversion path 122. After the trailing end of the recording sheet passes through the flapper 121, the recording sheet is switched-back and guided by the flapper 121 to discharge rollers 118 by which the recording sheet is discharged, with a printed surface directed downward (face down).

Toner is supplied from toner supply units 101*y*, 101*m*, 101*c*, and 101*k* to respective ones of the developing units 102*y*, 102*m*, 102*c*, and 102*k*.

Figure 2:
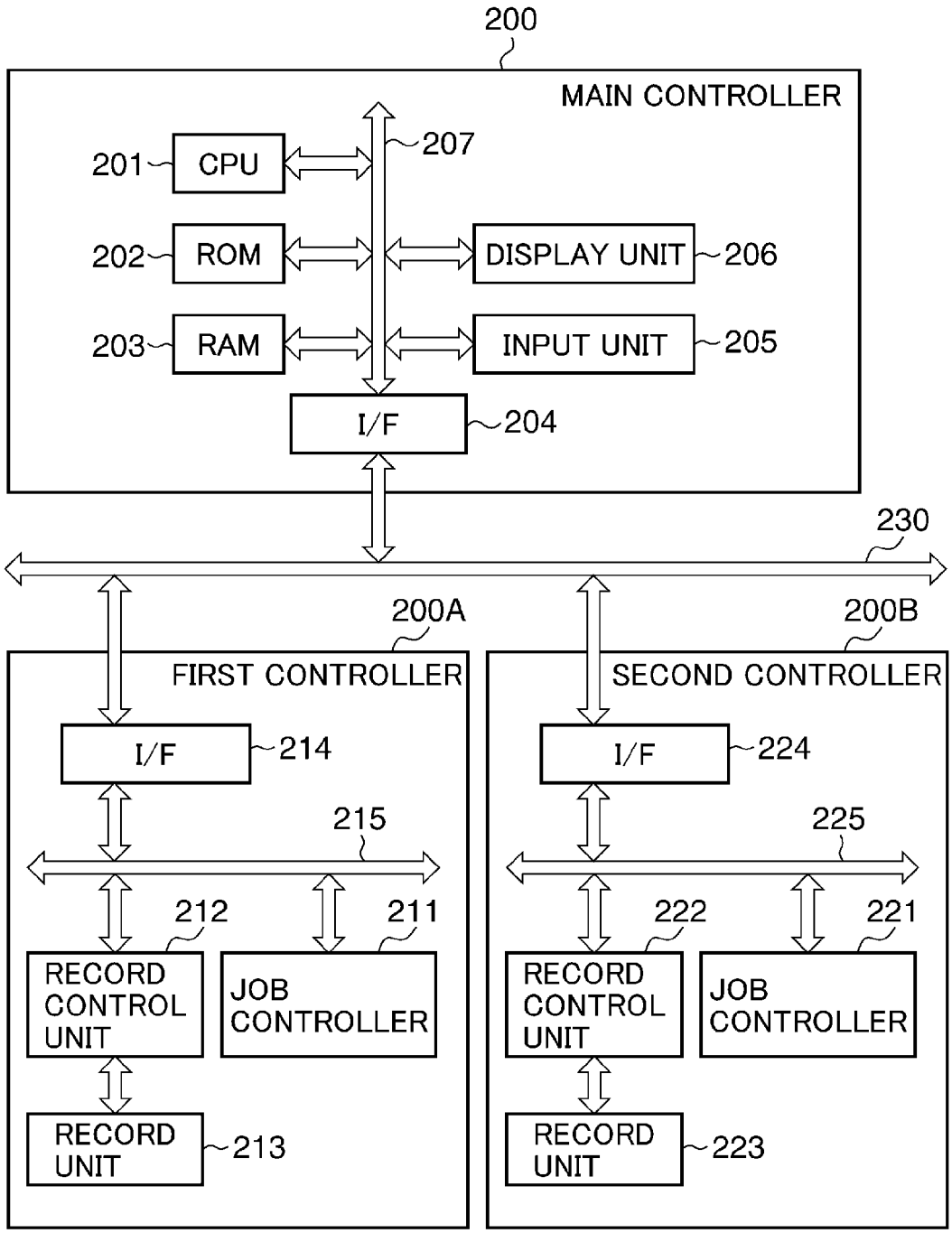
FIG. 2 is a block diagram showing control functions of the image forming system shown in FIG. 1.

FIG. 2 is a block diagram showing control functions of the image forming system 100. As shown in FIG. 2, the image forming system 100 includes a main controller 200 and first and second controllers 200A, 200B. In the illustrated example, the main controller 200 is disposed in the first image forming apparatus 100A, and the first and second controllers 200A, 200B are disposed in the first and second image forming apparatuses 100A, 100B, respectively.

The main controller 200 includes a CPU (central processing unit) 201, a ROM (read only memory) 202, a RAM (random access memory) 203, an I/F (interface) unit 204, an input unit 205, and a display unit 206, which are connected with one another via an internal bus 207.

The first controller 200A includes a job controller 211, a record control unit 212, a record unit 213, and an I/F unit 214, which are connected to one another via an internal bus 215. Similarly, the second controller 200B includes a job controller 221, a record control unit 222, a record unit 223, and an I/F unit 224, which are connected to one another via an internal bus 225.

As shown in FIG. 2, the I/F units 204, 214, and 224 are connected to one another via an external bus 230, whereby the main controller 200 is able to communicate with the first and second controllers 200A, 200B.

The ROM 202 stores a control program based on which the CPU 201 controls the entire image forming system 100. The RAM 203 is used by the CPU 201 as a work area to control the image forming system 100.

The RAM 203 stores image data obtained by reading an original and image data obtained from an external device (e.g., personal computer). The RAM 203 is also used as a work area when image data is processed.

The input unit 205 is also called an operation unit 205. By using the input unit 205, a user sets a desired job to be performed by the image forming system 100. Specifically, the user inputs via the input unit 205 a job command to instruct the image forming system 100 to perform the job. In response to the job command, the CPU 201 causes the reader scanner to read one or more originals placed on the original setting table 117A.

In a case that the job command is a single-sided/double-sided printing command, the CPU 201 performs image processing on image information obtained by the reading of the one or more originals to thereby obtain image data, and stores the image data into the RAM 203. It should be noted that it is possible to input the job command to the image forming system 100, e.g., from the external device, without using the input unit 205. Information required to perform image formation is displayed on the display unit 206.

The I/F unit 204 is also connected to a network such as a TCP/IP network, and receives a job command from an external device, e.g., a personal computer, which is connected to the network. The I/F unit 204 is able to notify, via the network, the external device of various internal information about the image forming system 100.

The I/F unit 214 in the first controller 200A and the I/F unit 224 in the second controller 200B receive information about a job from the I/F unit 204 of the main controller 200, and respectively deliver the job information to the job controllers 211, 221. Based on the job information, the job controllers 211, 221 respectively control the first and second image forming apparatuses 100A, 100B.

The record control units 212, 222 respectively execute record control for the record units 213, 223 according to instructions given by the job controllers 211, 221. The record units 213, 223 correspond to parts of the image forming apparatuses 100A, 100B shown in FIG. 1 that perform recording sheet conveyance, image exposure, development, transfer, fixing, etc.

Figure 3:
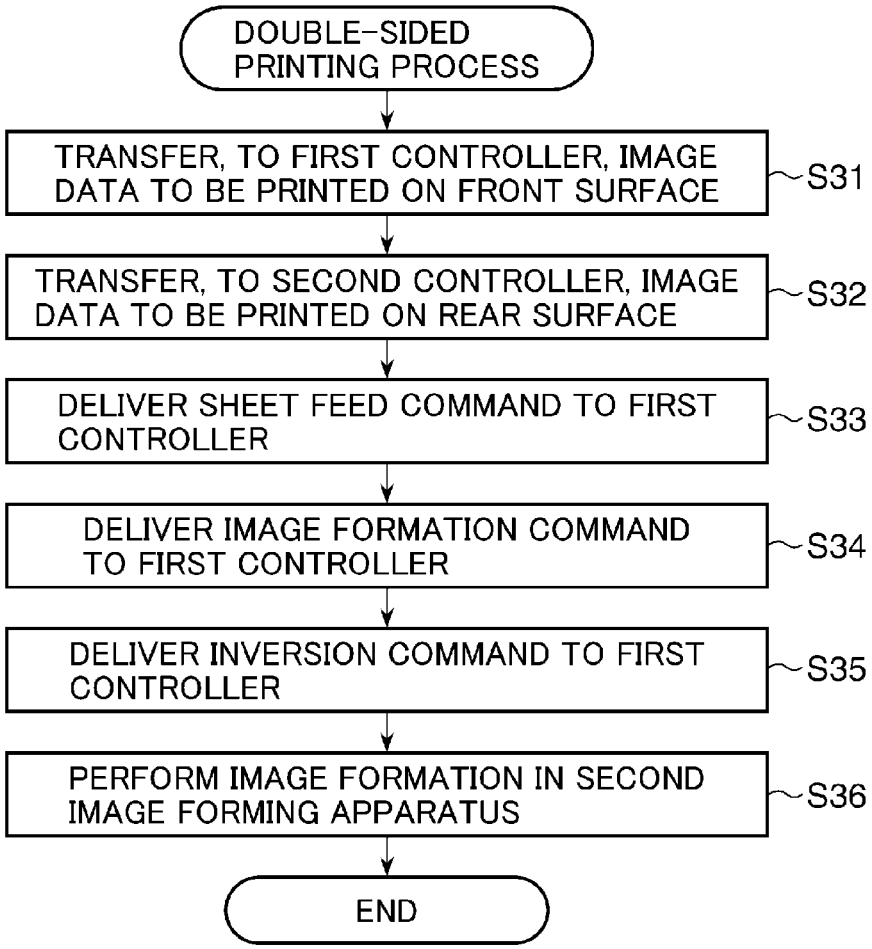
FIG. 3 is a flowchart showing a double-sided printing process executed by a main controller of the image forming system.

FIG. 3 shows in flowchart a double-sided printing process executed by the CPU 201 of the main controller 200 of the image forming system 100.

To perform double-sided printing, one or more originals are set on either one of the original setting tables 117A of the first and second image forming apparatuses 100A, 100B. It is assumed here that an original is set on the original setting table 117A of the first image forming apparatus 100A. Both surfaces of the original are read by the reader scanner unit, and image data is created from read image information and temporarily stored into the ROM 203.

In step S31, the CPU 201 of the main controller 200 transfers, to the first image forming apparatus 100A (i.e., to the first controller 200A), image data to be printed on one surface (e.g., front surface) of the recording sheet among the image data stored in the ROM 203. The transferred image data is temporarily stored into the job controller 211. Next, the CPU 201 transfers image data to be printed on another surface (e.g., rear surface) of the recording sheet to the second image forming apparatus 100B (i.e., to the second controller 200B) in step S32. The transferred image data is temporarily stored into the job controller 221.

The CPU 201 delivers a sheet feed command to the job controller 211 of the first controller 200A (step S33). In response to the command, the job controller 211 controls the first image forming apparatus 100A to feed a recording sheet from, e.g., the recording sheet cassette 109 or 110. Then, the CPU 201 delivers an image formation command to the job controller 211 of the first controller 200A (step S34). In response to the image formation command, the job controller 211 of the first image forming apparatus 100A controls the record control unit 212 to form an image on the front surface of the recording sheet based on the image data.

Next, the CPU 201 delivers a recording sheet inversion command to the job controller 211 of the first controller 200A (step S35). Under the control of the job controller 211, a toner image is fixed onto the recording sheet which is then conveyed to the inversion path 122 in the first image forming apparatus 100A. The recording sheet is inverted at the inversion path 122 and fed to the discharge rollers 118 by which the recording sheet is conveyed from the first image forming apparatus 100A to the second image forming apparatus 100B. The recording sheet conveyed to the second image forming apparatus 100B is received by the sheet feeder 111 and fed into the inside of the second image forming apparatus 100B.

In the second image forming apparatus 100B, printing is performed on the rear surface of the recording sheet in the same processing procedures executed in the first image forming apparatus 100A. Specifically, the CPU 201 delivers an image formation command to the job controller 221 of the second controller 200B, whereby image formation is started.

In the image formation, a toner image is formed on and fixed to the rear surface of the recording sheet, and the recording sheet is discharged by the discharge rollers 118 from the second image forming apparatus 100B to the outside, without being inverted (step S36). Then, the CPU 201 of the main controller 200 completes the double-sided printing process.

In a case that post-processing is specified to be performed, the post-processing apparatus 500 performs the post-processing, whereby a printed product is completed.

Figure 4:
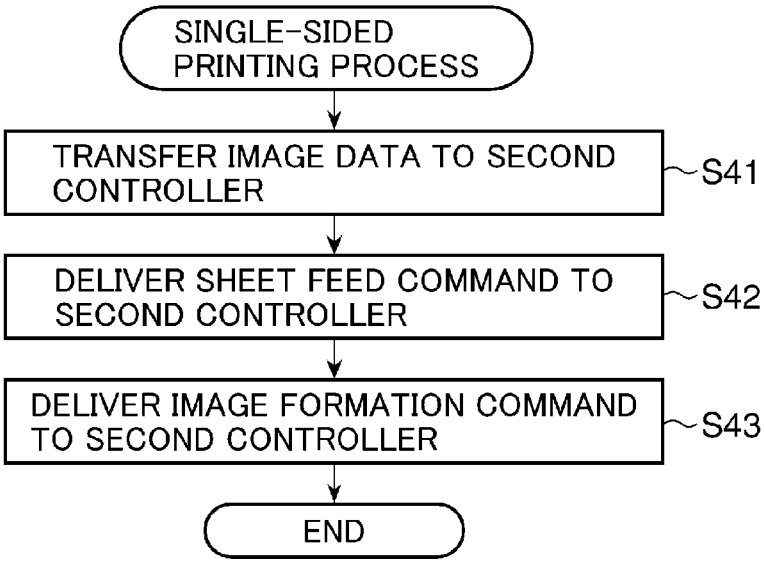
FIG. 4 is a flowchart showing a single-sided printing process executed by the main controller.

FIG. 4 shows in flowchart a single-sided printing process performed by the CPU 201 of the main controller 200.

To perform single-sided printing, one or more originals are set on either one of the original setting tables 117A of the first and second image forming apparatuses 100A, 100B.

It is assumed here that an original is set on the original setting table 117A of the second image forming apparatus 100B. One surface of the original is read by the reader scanner unit, and image data is created from read image information and temporarily stored into the ROM 203.

For the single-sided printing, one of the first and second image forming apparatuses 100A, 100B is employed. It is assumed here that the second image forming apparatus 100B (i.e., the downstream image forming apparatus) is employed for the single-sided printing.

This is because in the case of using the second image forming apparatus 100B, image formation and recording sheet conveyance can be carried out only by the second image forming apparatus 100B, even if the first image forming apparatus 100A (i.e., the upstream image forming apparatus) is held in a sleep state. Conversely, in a case that the first image forming apparatus 100A is used for the single-sided printing, the second image forming apparatus 100B must also be operated to discharge the recording sheet through the apparatus 100B, resulting in increase in power consumption and reduction in service life of component parts.

In step S41, the CPU 201 of the main controller 200 transfers, to the second image forming apparatus 100B (i.e., to the second controller 200A), image data to be printed on a recording sheet among the image data stored in the ROM 203. Next, the CPU 201 delivers a sheet feed command to the job controller 211 of the second controller 200B (step S42). In response to the command, the job controller 211 performs control to feed a recording sheet from, e.g., the recording sheet cassette 109 or 110 of the second image forming apparatus 100B.

Then, the CPU 201 delivers an image formation command to the job controller 211 of the second controller 200B (step S43). In response to the image formation command, the job controller 211 controls the record control unit 212 to form an image on the front surface of the recording sheet based on the image data.

In the second image forming apparatus 100B, the recording sheet to which a toner image is fixed is conveyed to the discharge rollers 118 by which the recording sheet is discharged to the outside of the second image forming apparatus 100B. In a case that post-processing is specified to be performed, the post-processing apparatus 500 performs the post-processing, whereby a printed product is completed. Then, the CPU 201 of the main controller 200 completes the single-sided printing process.

Next, a description will be given of sleep control (state control) performed in the image forming system 100. In the standby state, each of the first and second image forming apparatuses 100A, 100B performs, e.g., a temperature adjustment for the fixing unit 107 and consumes electric power.

On the other hand, in the sleep state where electric power consumption is smaller than in the standby state, electric power is supplied to only the job controller 211 or 221 of each image forming apparatus 100A or 100B, while stopping power supply to electric loads such as a heater, whereby electric consumption is reduced.

Sleep control is executed according to an instruction given by the CPU 201 of the main controller 200. Specifically, a sleep command is given from the CPU 201 to one or both of the job controllers 211, 221, and each job controller 211 or 221 controls power supply to each image forming apparatus 100A or 100B.

If a user operates the input unit 205 to give an instruction to shift one or both of the first and second image forming apparatuses 100A, 100B to the sleep state and then operates the input unit 205 to set a sleep transition time, the CPU 201 determines whether the sleep transition time has passed from the start of standby state, while referring to a value counted by a built-in timer. When determining that the sleep transition time has passed, the CPU 201 issues, via the I/F unit 204, a sleep transition command to the specified image forming apparatus(es), thereby shifting the image forming apparatus (es) to the sleep state.

As described above, when no printing is performed, the CPU 201 controls each of the first and second image forming apparatuses 100A, 100B to assume either the standby state where printing can immediately be started or the sleep state where at least power consumption is lower than in the standby state.

Next, a description will be given of restoration from the sleep state to the standby state. To restore from the sleep state to the standby state, the image forming system 100 performs initial positioning of a control motor (not shown) of each image forming apparatus 100A or 100B to be restored.

It is further necessary to make initial settings of each image forming apparatus 100A or 100B and adjust the temperature of the fixing unit 107 to a standby temperature. A time period required for the adjustment of fixing unit temperature is about three minutes at the maximum. When the fixing unit 107 is in a cold state, it takes about three minutes to restore from the sleep state to the standby state.

If a shift from the standby state to the sleep state occurs after completion of printing, although the fixing unit temperature varies depending on the time lapsed from the completion of printing, the fixing unit 107 is at a somewhat high temperature and therefore restoration from the sleep state to the standby state can be achieved in a shorter time.

To restore from the sleep state to the standby state, the CPU 201 issues, via the I/F unit 231, a restoration command to one or both of the first and second controllers 200A, 200B.

Figure 5:
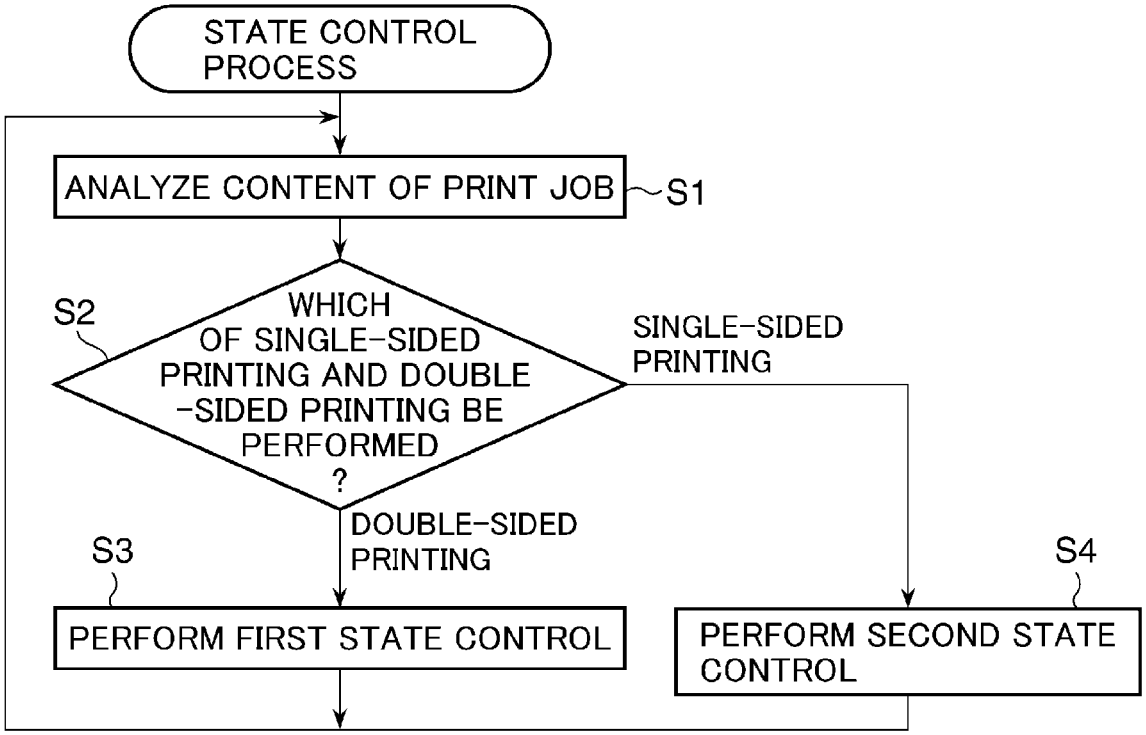
FIG. 5 is a flowchart showing a state control process executed by the main controller.

FIG. 5 shows in flowchart a state control process executed by the CPU 201 of the main controller 200. FIG. 6A shows a decision table referred to by the CPU 201 of the main controller 200 to execute the state control process at double-sided printing, and FIG. 6B shows a decision table referred to during the state control process at single-sided printing.

The decision tables shown in FIGS. 6A and 6B represent respective states of the first and second image forming apparatuses 100A, 100B and are stored in the ROM 202.

The CPU 201 analyzes the content of a print job that is input to the image forming system 100 (step S1).

Based on a result of the analysis, the CPU 201 determines which of single-sided printing and double-sided printing should be performed (step S2). When determining in step S2 that double-sided printing should be performed, the CPU 201 performs first state control to shift the first and second image forming apparatuses 100A, 100B to the sleep state or to the standby state based on the decision table shown in FIG. 6A (hereinafter, referred to as the first decision table) (step S3).

In the first state control, the CPU 201 refers to the first decision table and determines whether both the first and second image forming apparatuses 100A, 100B are in the sleep state. When determining that both the apparatuses are in the sleep state, the CPU 201 restores the first and second image forming apparatuses 100A, 100B to the standby state. Subsequently, the CPU 201 transfers image data to be printed on front surfaces of recording sheets to the first controller 200A, and transfers image data to be printed on rear surfaces of the recording sheets to the second controller 200B. When determining based on the first decision table that only the first image forming apparatus 100A is in the sleep state, the CPU 201 restores the first image forming apparatus 100A to the standby state, and performs the above-described image data transfer to the controllers 200A, 200B. When determining based on the first decision table that only the second image forming apparatus 100B is in the sleep state, the CPU 201 restores the second image forming apparatus 100B to the standby state, and performs the image data transfer to the controllers 200A, 200B. When determining that both the first and second image forming apparatuses 100A, 100B are in the standby state, the CPU 201 leaves the first and second image forming apparatuses in the standby state. After step S3 is executed, the flow returns to step S1.

On the other hand, when determining in step S2 that single-sided printing should be performed, the CPU 201 performs second state control to shift the first and second image forming apparatuses 100A, 100B to the sleep state or the standby state based on the decision table shown in FIG. 6 B (hereinafter, referred to as the second decision table) (step S4).

In the second sleep control, when determining by referring to the second decision table that both the first and second image forming apparatuses 100A, 100B are in the sleep state, the CPU 201 restores only the second image forming apparatus 100B to the standby state, and transfers image data to be printed on front surfaces of recording sheets to the second controller 200B.

When determining based on the second decision table that only the first image forming apparatus 100A is in the sleep state, the CPU 201 maintains the first image forming apparatus 100A in the sleep state since only the second image forming apparatus 100B is used for the single-sided printing. Subsequently, the CPU 201 performs the image data transfer to the second controller 200B.

When determining based on the second decision table that only the second image forming apparatus 100B is in the sleep state, the CPU 201 restores the second image forming apparatus 100B to the standby state, and shifts the first image forming apparatus 100A to the sleep state. Subsequently, the CPU 201 performs the image data transfer to the second controller 200B. When determining that both the first and second image forming apparatuses 100A, 100B are in the standby state, the CPU 201 shifts only the first image forming apparatus 100A to the sleep state, and performs the image data transfer to the second controller 200B.

As apparent from the foregoing description, the CPU 201 has a function of a control unit to decide based on a result of analysis of image data whether each of the first and second image forming apparatuses 100A, 100B should be restored from the sleep state to the standby state or should be shifted from the standby state to the sleep state.

With the above-described embodiment, each of the first and second image forming apparatuses 100A, 100B can be shifted to either the sleep state or the standby state according to whether the double-sided printing should be performed or the single-sided printing should be performed. Accordingly, it is possible to reduce unnecessary power consumption, to immediately respond to a job command given by a user, and to prevent the service life of component parts from being adversely affected.

Other Embodiments

Aspects of the present invention can also be realized by a computer of a system or apparatus (or devices such as a CPU or MPU) that reads out and executes a program recorded on a memory device to perform the functions of the above-described embodiment, and by a method, the steps of which are performed by a computer of a system or apparatus by, for example, reading out and executing a program recorded on a memory device to perform the functions of the above-described embodiment. For this purpose, the program is provided to the computer for example via a network or from a recording medium of various types serving as the memory device (e.g., computer-readable medium).

While the present invention has been described with reference to an exemplary embodiment, it is to be understood that the invention is not limited to the disclosed exemplary embodiment. The scope of the following claims is to be accorded the broadest interpretation so as to encompass all such modifications and equivalent structures and functions.

This application claims the benefit of Japanese Patent Application No. 2010-008149, filed Jan. 18, 2010, which is hereby incorporated by reference herein in its entirety.

What is claimed is:

1. An image forming system comprising:

a first image forming apparatus that has a first containing section for holding a plurality of recording sheets and that forms an image on one of the recording sheets conveyed from the first containing section;

a second image forming apparatus that has a second containing section for holding a plurality of recording sheets and that forms an image on one of the recording sheets conveyed from the second containing section, the second image forming apparatus being coupled to a downstream side of the first image forming apparatus in a recording sheet conveyance direction;

a receiving unit configured to receive a print job from an external device;

a first control unit disposed in said first image forming apparatus and configured to control an image forming operation of the first image forming apparatus;

a second control unit disposed in said second image forming apparatus and configured to control an image forming operation of the second image forming apparatus; and a third control unit configured to:

cause, based on the print job, each of said first control unit and said second control unit to respectively control the first image forming apparatus and the second image forming apparatus to assume a standby state where a fixing unit that fixes the image on the recording sheets is maintained at a predetermined temperature or a sleep state where a power consumption is lower than in the standby state;

determine whether the print job received by said receiving unit is single-sided printing where an image formed on one surface of a recording sheet or double-sided printing where an image is formed on both sides thereof;

in a case where the third control unit determines that the print job received by said receiving unit is double-sided printing where images are to be formed on both sides of a recording sheet, cause said first control unit and said second control unit to respectively control both the first and second image forming apparatuses to assume the standby state, and assign the print job to said first control unit and said second control unit to cause the first image forming apparatus to form the image on one side of the recording sheet that is conveyed from the first containing section and then cause the second image forming apparatus to form the image on the other side of the recording sheet with the one side formed with the image by the first image forming apparatus; and in a case where the third control unit determines that the print job received by said receiving unit is single-sided printing where an image is to be formed only on one side of a recording sheet, cause said first control unit to control the first image forming apparatus to assume the sleep state and said second control unit to control the second image forming apparatus to assume the standby state, and transmit the print job to said second control unit to cause the second image forming apparatus to form the image on the one side of the recording sheet that is conveyed from the second containing unit.

2. The image forming system according to claim 1, wherein:

in a case where the single-sided printing is to be performed, said third control unit controls said first control unit to cause the first image forming apparatus to remain in the sleep state, if the first image forming apparatus is in the sleep state, and in a case where the single-sided printing is to be performed, said third control unit controls said first control unit to cause the first image forming apparatus to shift to the sleep state, if the first image forming apparatus is in the standby state.

3. A control method of controlling an image forming system comprising:

a first image forming apparatus that has a first containing section for holding a plurality of recording sheets and that forms an image on one of the recording sheets conveyed from the first containing section;

a second image forming apparatus that has a second containing section for holding a plurality of recording sheets and that forms an image on one of the recording sheets conveyed from the second containing section, the second image forming apparatus being coupled to a downstream side of the first image forming apparatus in a recording sheet conveyance direction;

a receiving unit configured to receive a print job from an external device;

a first control unit disposed in said first image forming apparatus and configured to control an image forming operation of the first image forming apparatus;

a second control unit disposed in said second image forming apparatus and configured to control an image forming operation of the second image forming apparatus; and a third control unit configured to:

determine whether the print job received by the receiving unit is single-sided printing where an image formed on one surface of a recording sheet or double-sided printing where an image is formed on both sides thereof;

cause, based on the print job, each of said first control unit and said second control unit to respectively control the first image forming apparatus and the second image forming apparatus to assume a standby state where a fixing unit that fixes the image on the recording sheets is maintained at a predetermined temperature or a sleep state where a power consumption is lower than in the standby state, the control method comprising the steps of:

receiving a print job from the external device via the receiving unit;

in a case where the third control unit determines that the received print job is double-sided printing where images are to be formed on both sides of a recording sheet, causing the first control unit and the second control unit to respectively control both the first and second image forming apparatuses to assume the standby state, and assigning the print job to the first control unit and the second control unit to cause the first image forming apparatus to form the image on the one side of the recording sheet that is conveyed from the first containing section and then causing the second image forming apparatus to form the image on the other side the recording sheet with the one side formed with the image by the first image forming apparatus; and in a case where the third control unit determines that the received print job is single-sided printing where an image is to be formed only on one side of a recording sheet, causing the first control unit to control the first image forming apparatus to assume the sleep state and said second control unit to control the second image forming apparatus to assume the standby state, and transmitting the print job to the second control unit to cause the second image forming apparatus to form the image on the one side of the recording sheet that is conveyed from the second containing unit.

4. A non-transitory computer-readable storage medium storing a program for causing a computer to execute the control method as set forth in claim 3.

5. A control apparatus for controlling an image forming system including first and second image forming apparatuses each for forming an image on a recording sheet, the second image forming apparatus being coupled to a downstream side of the first image forming apparatus in a recording sheet conveyance direction, the first image forming apparatus having a first control unit configured to control an image forming operation thereof, and the second image forming apparatus having a second control unit configured to control an image forming operation thereof, the control apparatus comprising:

a receiving unit configured to receive a print job from an external device; and a control unit configured to:

determine whether the print job received by said receiving unit is single-sided printing where an image formed on one surface of a recording sheet or double-sided printing where an image is formed on both sides thereof;

cause, based on the print job, each of said first control unit and said second control unit to respectively control the first and second image forming apparatuses to assume a standby state where a fixing unit that fixes the image on the recording sheets is maintained at a predetermined temperature or a sleep state where a power consumption is lower than in the standby state;

in a case where said control unit determines that the print job received by said receiving unit is double-sided printing where images are to be formed on both sides of a recording sheet, cause said first control unit and said second control unit to respectively control both the first and second image forming apparatuses to assume the standby state, and assign the print job to said first control unit and said second control unit to cause the first image forming apparatus to form the image on the one side of the recording sheet that is conveyed from the first containing section and then cause the second image forming apparatus to form the image on the other side of the recording sheet with the one side formed with the image by the first image forming apparatus; and in a case where said control unit determines that the print job received by said receiving unit is single-sided printing where an image is to be formed only on one side of a recording sheet, cause said first control unit to control the first image forming apparatus to assume the sleep state and said second control unit to control the second image forming apparatus to assume the standby state, and transmit the print job to said second control unit to cause the second image forming apparatus to form the image on the one side of the recording sheet that is conveyed from the second containing unit.

* * * * *